US006033240A

United States Patent [19]

Goff

[11] Patent Number: 6,033,240

[45] Date of Patent: Mar. 7, 2000

[54] RETRACTABLE MEDIA JACK OPERABLE WITH TWO DISCRETE MEDIA CONNECTORS

[75] Inventor: Darrell E. Goff, E. Layton, Utah

[73] Assignee: 3Com Corporation, Santa Clara, Calif.

[21] Appl. No.: 09/183,839

[22] Filed: Oct. 30, 1998

[51] Int. Cl.[7] ..... H01R 13/44

[52] U.S. Cl. ..... 439/131; 439/946

[58] Field of Search ..... 439/131, 188, 439/676, 942.6, 942, 946, 955

[56] References Cited

U.S. PATENT DOCUMENTS

| | | | |
|---|---|---|---|
| 5,183,404 | 2/1993 | Aldous et al. | 439/55 |
| 5,336,099 | 8/1994 | Aldous et al. | 439/131 |
| 5,338,210 | 8/1994 | Beckham et al. | 439/131 |
| 5,547,401 | 8/1996 | Aldous et al. | 439/676 |
| 5,727,972 | 3/1998 | Aldous et al. | 439/655 |
| 5,773,332 | 6/1999 | Glad | 439/344 |
| 5,797,771 | 8/1998 | Garside | 439/610 |
| 5,816,832 | 10/1998 | Aldous et al. | 439/131 |

*Primary Examiner*—Steven L. Stephan

*Assistant Examiner*—J. F. Duverne

*Attorney, Agent, or Firm*—Workman, Nydegger & Seeley

[57] ABSTRACT

A media jack includes a plate retractably positioned within an opening on a PC card or other electrical apparatus. The plate includes an elongated thin body portion having an enlarged head portion formed at the end thereof. Extending through the body portion is an aperture having a plurality of contact wires projecting therein. The aperture is configured to receive an RJ type connector so that the connector is in electrical communication the contact wires. The enlarged head portion has a front face and an opposing back face which is position below the body portion. Formed on the front face is a socket having electrical contacts received therein. The socket is configured to electrically couple with a PC card type connector. Formed on the back face of the head portion is a slot having a plurality of discrete female contacts. Each of the female contacts are in electrical communication with the contacts in the front socket by electrical lines. Positioned within the opening of the electrical apparatus below the body portion of the plate are a plurality of rigidly positioned male contacts. The female contacts on the retractable plate are configured to electrically couple with male contacts positioned in the housing when the plate is slide back into the retracted position.

18 Claims, 6 Drawing Sheets

RETRACTABLE MEDIA JACK OPERABLE WITH TWO DISCRETE MEDIA CONNECTORS

BACKGROUND OF THE INVENTION

1. The Field of the Invention

The present invention relates to electrical receptacles and, more specifically, discrete media jacks that are configured to physically receive and electrically couple with two media connectors such as an RJ type connector and a PC card type connector.

2. Present State of the Art

Electrical apparatus, such as personal computers, cellular telephones, and personal information managers (PIMs), are becoming increasingly dependent upon their ability to electrically communicate or share information with other electrical apparatus. To facilitate this electrical communication, a variety of different types of electrical couplers have been developed. An electrical coupler includes a connector or plug and a corresponding jack. The jack typically includes an aperture or socket configured to receive the connector so as to establish electrical communication therebetween.

Select types of electrical couplers have been designed for use with PC cards. A PC card is a small thin card typically having a standard size. A connector formed at one end is configured to couple with the electrical apparatus. A jack is formed at the opposing end of the PC card is configured to couple with a desired outside line such as a telephone line or a network line. Disposed within the PC card is a circuit board providing the necessary circuitry to perform one or more intended functions. For example, in one type of PC card, the circuit board comprises a modem which enables the electrical apparatus to receive and transmit information over telephone lines. In another PC card, the circuit board enables the electrical apparatus to receive and transmit information with a network system over a network cable.

One conventional type of jack used for connecting a PC card to an exterior line comprises a thin plate which is retractable within the PC card. The plate has a top surface with an aperture formed therein. The aperture is configured to receive an RJ type connector such as an RJ-11, commonly referred to as a telephone plug.

Another conventional type of coupler used for connecting a PC card to an exterior line comprises a low profile PC card connector. The PC card connector includes a long thin plug. A corresponding jack is formed on the PC card and includes a long thin socket configured to receive the plug.

Each of the RJ type connectors and PC card type connectors have unique benefits and are used extensively in the electrical field. Unfortunately, they are not interchangeable in that an RJ connector cannot be inserted into a jack for a PC card connector. Accordingly, adapters are required to facilitate electrical communication between the different connector and jack configurations. Such adapters, however, complicate the connection process and are often lost or misplaced. Furthermore, due to space and size limitations, positioning two or more different types of jacks side by side on a PC card is impractical or at least a loss of valuable space.

OBJECTS AND BRIEF SUMMARY OF THE INVENTION

Accordingly, it is an object of the present invention to provide a media jack for electrically coupling with first and second media connectors of different configuration.

Another object of the present invention is to provide a media jack as above which minimizes the required space.

Yet another object is to provide the above media jack which eliminates the need for using an adapter with either the first or second media connector.

Specifically, it is an object of the present invention to provide a media jack that can selectively couple with either a RJ type connector or a PC card type connector without the required use of an adapter.

To achieve the foregoing objects, and in accordance with the invention as embodied and broadly described herein, a media jack is provided. In one embodiment, the media jack comprises a plate that can be selectively retracted into an opening of a PC card or other electrical apparatus. The plate has a substantially L-shaped side view which includes a thin elongated body portion having an enlarged head portion formed on the end thereof. Extending through the body portion is an aperture. Projecting from the body portion into the aperture are a plurality of contact wires. The aperture is configured to receive an RJ type connector so that the RJ connector is in electrical communication with the contact wires.

The enlarged head portion has a front face and an opposing back face. The back face of the head portion is positioned below the body portion. Recessed within the front face is a front socket having a plurality of discrete contacts formed therein. The front socket is configured to received a PC card type connector so that the contacts are in electrical communication therewith. Recessed within the back face of the head portion is a slot having a plurality of discrete female contacts. Individual electrical lines extend from each of the contacts in the front socket to corresponding female contacts in the slot.

Positioned within the opening of the PC card or electrical apparatus are a plurality of male contacts. The male contacts are mounted on a circuit board or other supporting structure. As the plate is moved into the retracted position, each male contact engages a corresponding female contact on the head portion to effect electrical communication therewith. Accordingly, when the plate is in the retracted position, the contacts within the front socket are in electrical communication with the male contacts within the opening.

The inventive media jack has a variety of unique advantages over the present state of the art. Specifically, since the inventive media jack can couple with both an RJ type connector and a PC card type connector, no adapters are required. Furthermore, by having the aperture and socket formed on a single retractable plate, minimal space is occupied by the inventive media jack. Specifically, the inventive media jack occupies less space than if separate media jacks were placed side by side on the PC card.

These and other objects, features, and advantages of the present invention will become more fully apparent from the following description and appended claims, or may be learned by the practice of the invention as set forth hereinafter. dr

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
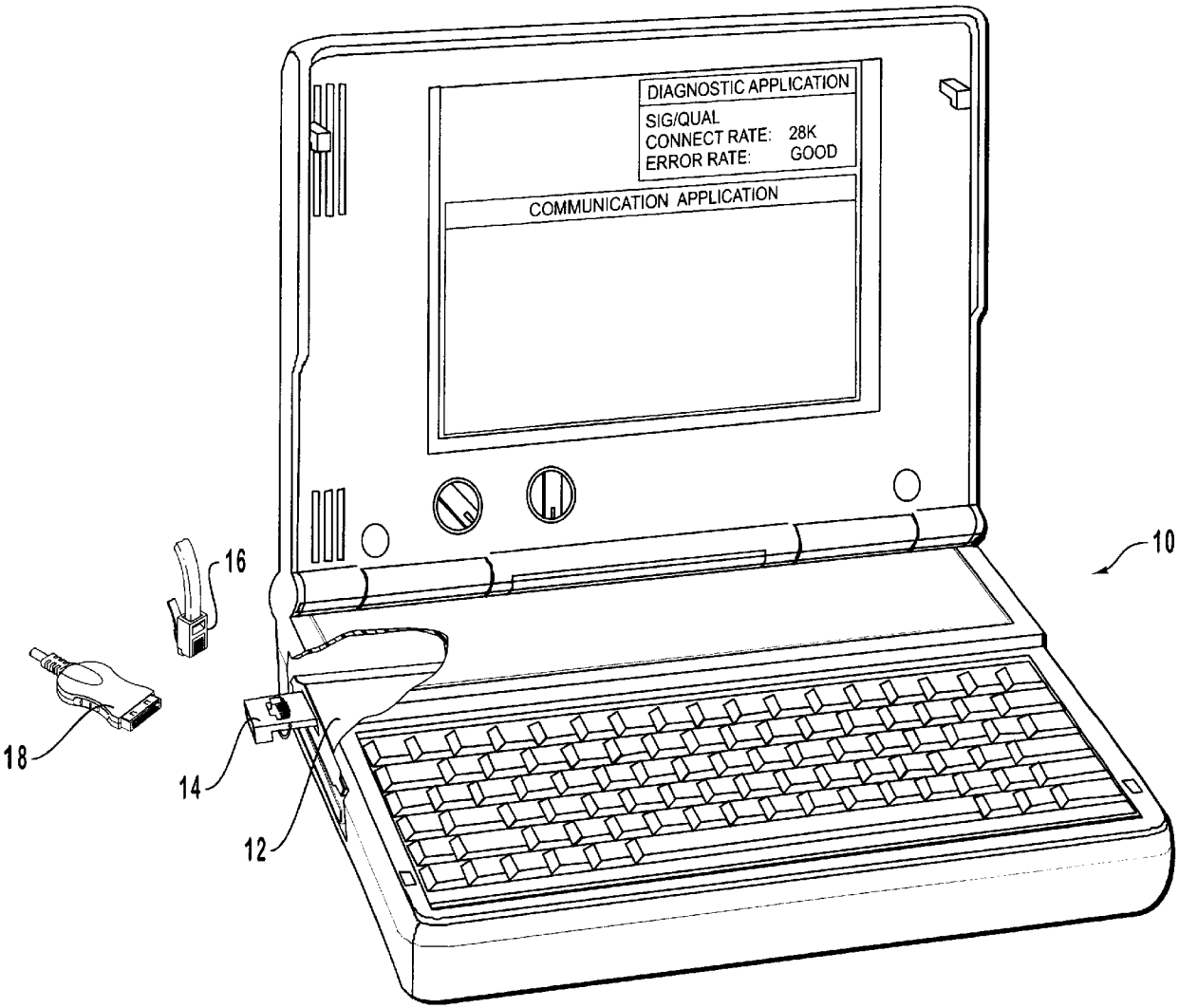
FIG. 1 is a perspective view of a PC card inserted within a computer, the PC card having an inventive media jack configured to receive an RJ type connector and a PC card type connector.

Depicted in FIG. 1 is a computer 10 housing a PC card 12. The term "PC card," as used in the specification and appended claims, is broadly intended to include the various types of cards falling within the Personal Computer Memory Card Internationals Association (PCMCIA) parameters, communication cards falling outside of those standards, and cards which are developed under new standards. Examples of PC cards include modem cards, network cards, memory cards, SCSI cards, cellular phone cards, and combinations thereof. Although not required, such PC cards can have a Type I, II, or III form factor.

Secured to PC card 12 is one embodiment of an inventive media jack 14 incorporating features of the present invention. Media jack 14 is configured to physically and electrically couple with a first media connector 16 and a second media connector 18. As used in the specification and appended claims, the term "media connector" is broadly intended to include connectors and plugs both currently known and those developed in the future which can be used to establish an electrical coupling for transferring electrical signals. Examples of media connectors include RJ type connectors such as an RJ-11, RJ-45, or other RJ-type connector and PC card type connectors. Examples of PC card type connectors are those connectors which fall under the specification of PCMCIA Specific Extensions found in the PCMCIA/JEIDA PC Card Standard. Other media connectors include D connectors, circular connectors, and ISB connectors. For purposes of illustrating an example of the present invention, first media plug 16 is depicted as an RJ-45 and second media plug 18 is depicted as a fifteen pin PC card connector.

Figure 2:
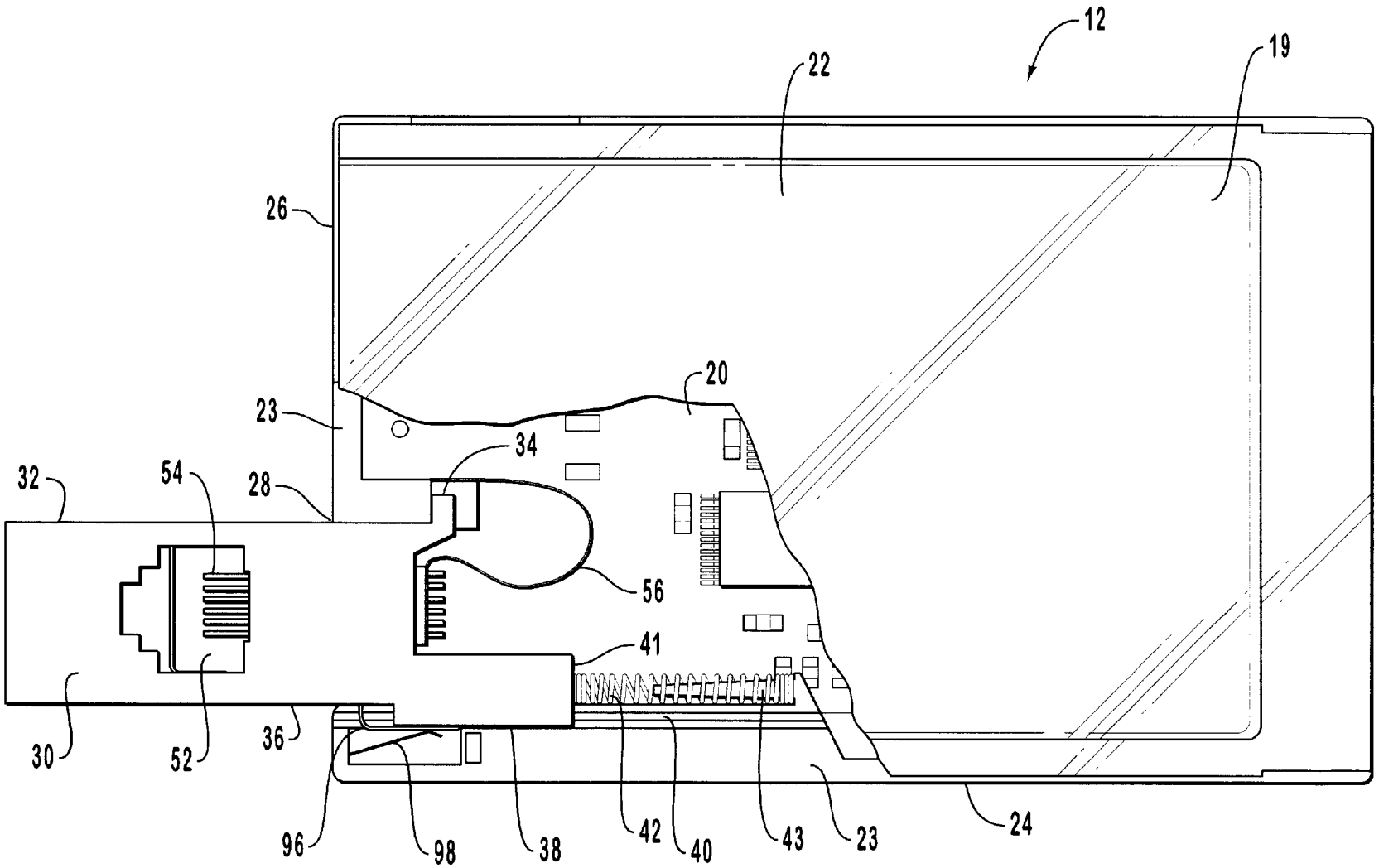
FIG. 2 is a partially cut away top view of the PC card shown in FIG. 1 having the inventive media jack projecting therefrom.
Figure 6:
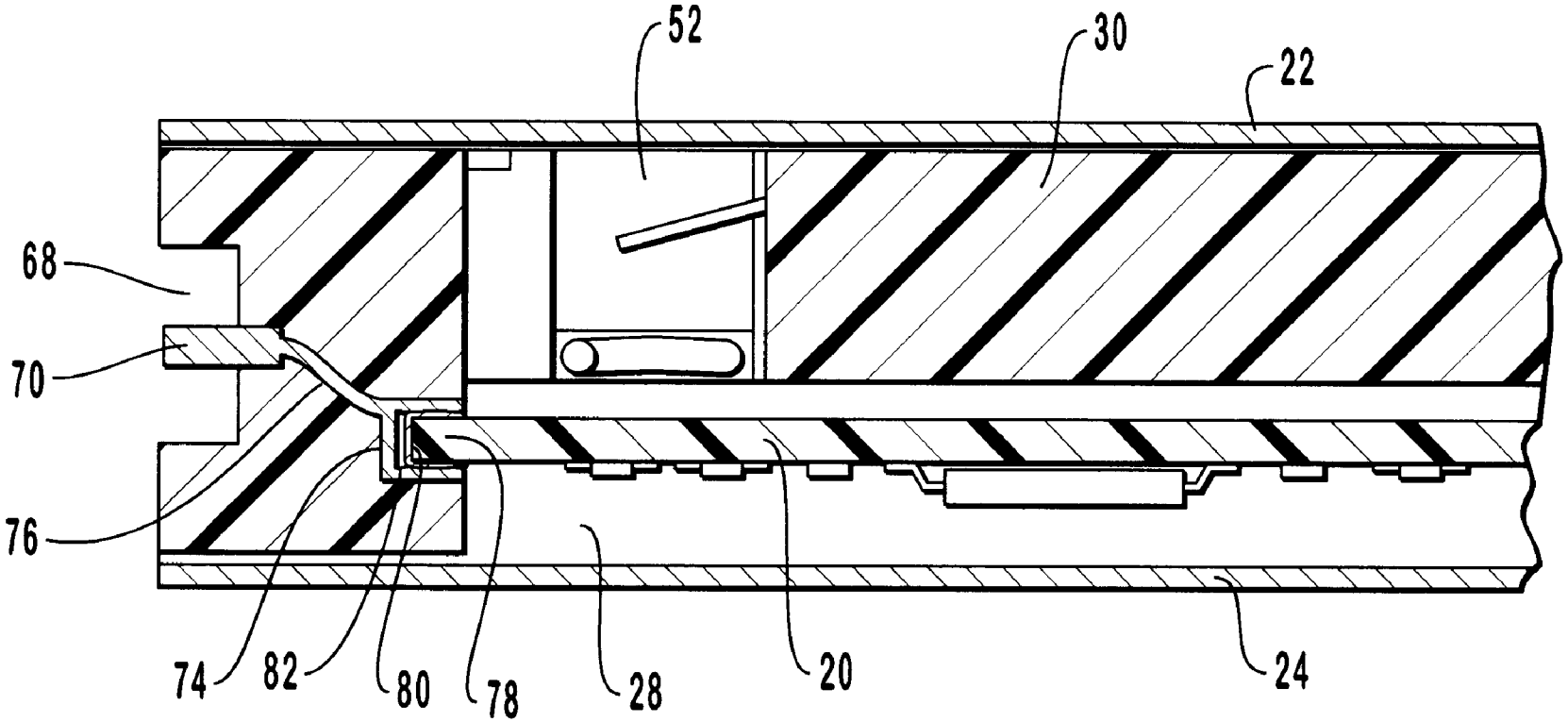
FIG. 6 is a cross sectional side view of the media jack shown in FIG. 4 in a retracted position.

Depicted in FIG. 2, PC card 12 comprises a housing 19 which includes a top cover plate 22, an opposing bottom cover plate 24, and a narrow border member 23 securing plates 22 and 24 together around the perimeter thereof. Positioned between cover plates 22 and 24 is a circuit board 20. Formed at a front end 26 of PC card 12 is an opening 28 extending through border member 23. Media jack 14 is slidably positioned within opening 28 over a portion of circuit board 20. Media Jack 14 is selectively movable between an extended position as shown in FIG. 2 and a retracted position as shown in FIG. 6.

Media jack 14 comprises an elongated plate 30 having a first side 32 with a stop 34 projecting at the end thereof and an opposing second side 36. In one embodiment of the present invention, means are provided for biasing plate 30 outward into the extended position. By way of example, formed at the end of side 36 is a tail 38. Tail 38 is slidably mounted on a rail 40 and has an opening 41 configured to receive a spring 42. The opposing end of spring 42 is mounted on a post 43. In this configuration, spring 42 functions to bias plate 30 outward into the extended position. In alternative embodiments, it is envisioned that spring 42 can be placed at different locations to bias against plate 30. Furthermore, spring 42 can be replaced with other conventional types of springs such as a leaf spring. Additional alternative embodiments are disclosed in U.S. Pat. No. 5,547,401, filed Aug. 16, 1994 (hereinafter "the '401 patent") and U.S. patent application Ser. No. 08/976,819, filed Nov. 24, 1997 (hereinafter "the '819 application) which are incorporated herein by specific reference.

Figure 3:
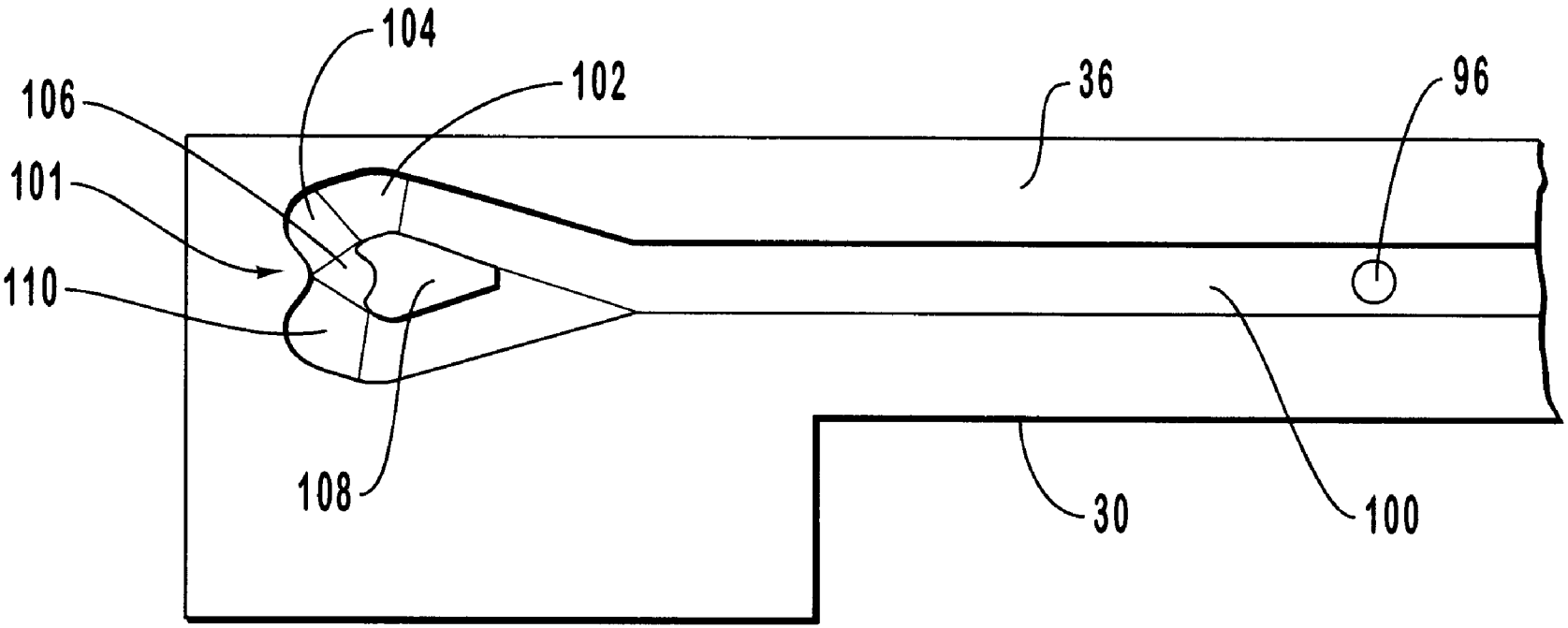
FIG. 3 is an elevated side view of the media jack shown in FIG. 2.

The present invention also includes means for selectively retaining plate 30 in the retracted position. By way of example and not by limitation, depicted in FIGS. 2 and 3, a channel 100 is recessed within second side 36 of plate 30. A substantially heart shaped ratcheted groove 101 is formed at the end of channel 100. Disposed within channel 100 is a small wire actuating arm 96 which is held in position by a spring 98. As plate 30 is manually advanced into opening 28, actuating arm 96 travels along channel 100 to ratcheted groove 101. Within ratcheted groove 101, actuating arm 96 travels up a first ramp 102 and then drops into a first step 104. As plate 30 is manually released, spring 42 produces a biasing outward force on plate 30 causing actuating arm 96 to drop into a second step 106 and bias against a brace 108.

The contact between actuating arm 96 and brace 108 prevents plate 30, which is continually urged by spring 42, from automatically advancing out into the extended position. To move plate 30 back into the extended position, plate 30 is manually pushed slightly into housing 24 causing actuating arm 96 to drop onto a third step 110. As plate 30 is released, actuating arm 96 slides within a descending ramp 112 and back into channel 100, thereby allowing plate 30 to freely slide outward into the extended position. The above process can be repeated to selectively move plate 30 between the retracted and extended position. Alternative embodiments of the means for selectively retaining are disclosed in the '401 patent and '819 application which were previously incorporated herein by specific reference.

Figure 4:
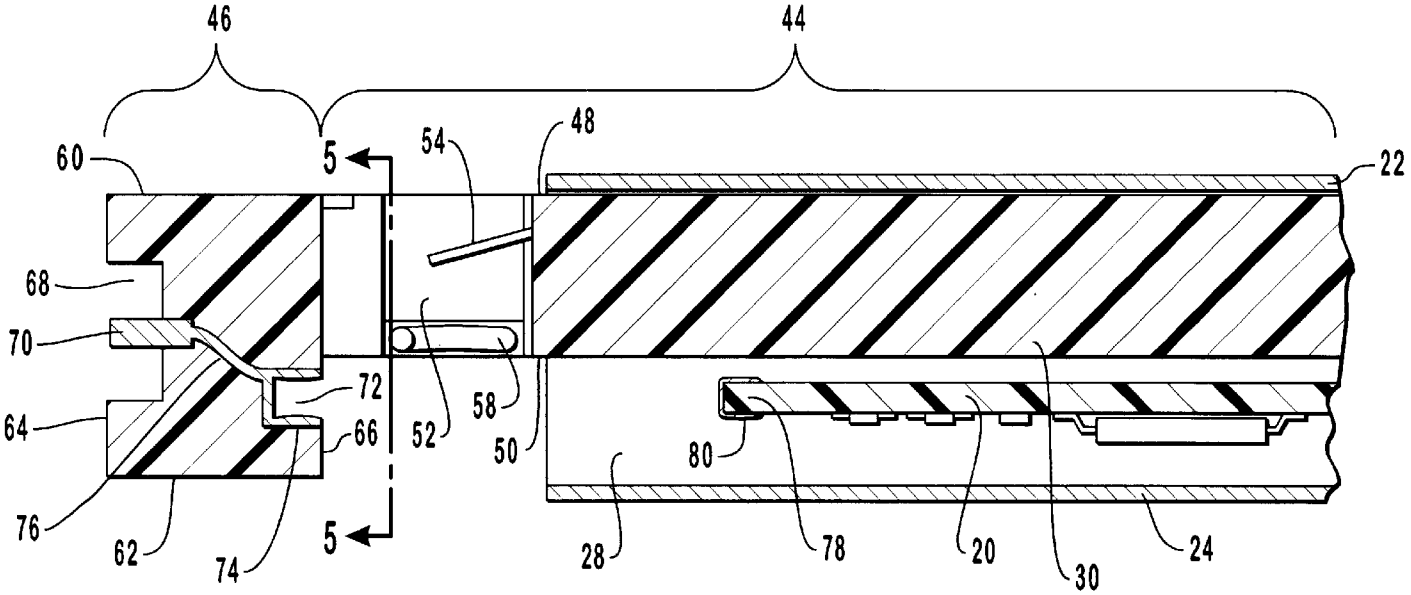
FIG. 4 is a cross-sectional side view of the media jack shown in FIG. 2 in an extended position.

As depicted in FIG. 4, plate 30 has a substantially L-shaped side view which comprises a substantially flat body portion 44 having a head portion 46 formed on the front end thereof. Body portion 44 has a substantially flat top surface 48 and an opposing flat bottom surface 50. In one embodiment of the present invention, means are provided for electrically coupling first media connector 16 with circuit board 20 when plate 30 is in the extended position. By way of example, extending between top surface 48 and bottom surface 50 of body portion 44 is an aperture 52. Projecting into aperture 52 are plurality of contact wires 54. Each of contact wires 54 electrically communicate with circuit board 20 through a flexible wire ribbon 56. Rotatably mounted within aperture 52 is a U-shaped harness 58. Aperture 52 is configured to receive first media connector 16 such that contact wires 54 electrically communication with first media connector 16. Harness 58 functions as a stop to prevent first media connector 16 from passing through aperture 52. One example of an aperture 52 configured to electrically couple with an first media connector 16 is found on the XJack® manufactured by 3Com out of Salt Lake City, Utah. Alternative examples of different structures configured to receive first media connector 16 for electrically coupling with circuit board 20 are disclosed in the '401 patent and '819 application which were previously incorporated herein by specific reference.

The present invention also includes means for electrically coupling second media connector 18 with circuit board 20 when plate 30 is in the retracted position. By way of example, head portion 46 comprises a top surface 60 that is flush with top surface 48 of body portion 44 and an opposing bottom surface 62 which extends below bottom surface 50 of body portion 44. Head portion 46 also includes a front face 64 and an opposing back face 66. Back face 66 extends from bottom surface 62 of head portion 46 to bottom surface 50 of body portion 44. Formed within front face 64 is a front socket 68 having a plurality of discrete contact pins 70 projecting therein. Socket 68 is configured to physically receive second media connector 18 such that contact pins 70 are in electrical communication therewith. In this regard, socket 68 can have substantially the same configuration as conventional sockets used for PC card type connectors.

Figure 5:
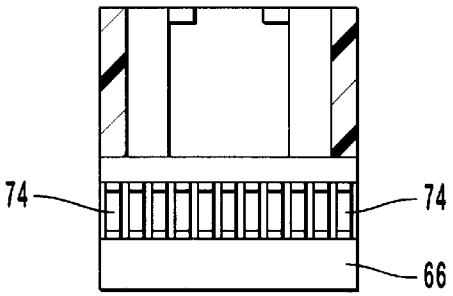
FIG. 5 is a cross sectional view of the media jack shown in FIG. 4 taken along section line 5—5.

The present invention also provides means for electrically coupling contact pins 70 with circuit board 20 when plate 30 is in its retracted position. By way of example and not by limitation, as depicted in FIGS. 4 and 5, a slot 72 is recessed within back face 66 of head portion 46. Disposed within slot 72 are a plurality of spaced apart female contacts 74. Each female contact 74 electrically communications with a corresponding contact pin 70 by a line 76.

As depicted in FIG. 4, circuit board 20 has a front end 78 having a plurality of male contacts 80 formed thereon. Male contacts 80 electrically communicate with desired circuitry on circuit board 20. As plate 30 is moved into the retracted position, as seen in FIG. 6, front end 78 of circuit board 20 is received within slot 72 such that each male contact 80 electrically communicates with a corresponding female contact 74, thereby effecting electrical communication between contact pins 70 and circuit board 20. It is noted that in the retracted position, a small gap 82 is formed between the base of female contact 74 and the lead face of male contact 80. Gap 82 enables plate 30 to be pushed slightly further into opening 28 for allowing plate 30 to subsequently extend outward as previously discussed with regard to the means for retaining plate 30 into the retracted position.

Based on the forgoing, when plate 30 is in the extended position, aperture 52 is openly exposed for receiving first media connector 16 in electrical communication with circuit board 20. In this extended position, however, female contacts 74 are separated from male contacts 80. Accordingly, contact pins 70 within socket 68 is not in electrical communication with circuit board 20. When plate 30 is in the retracted position, aperture 52 is disposed within housing 19 so that first media connector 16 cannot be received therein. Socket 68, however, can now receive second media connector 18 in electrical communication with circuit board 20.

The present invention also envisions a plurality of different embodiments which provide the means for electrically coupling contact pins 70 with circuit board 20 when plate 30 is in its retracted position. For example, it is appreciated that there are a variety of different types of contacts which can be used for or replace female contacts 74 and male contacts 80. By way of example, contacts 74 and 80 can be replaced with a connector and socket configuration such as that used with PC card type connectors or RJ type connectors. Furthermore, rather than being U-shaped so that the contacts are received within each other, flat contacts which only bias against a single surface can be used. In yet another embodiment, it is also not required that plate 30 be positioned over circuit board 20. In one embodiment, circuit board 20 can be cut out around plate 20 to allow more room for media jack 14. A separate contact structure which is wired with circuit board 20 can then be positioned so as to electrically couple with female contacts 74 when plate 30 is in the retracted position.

Figure 7:
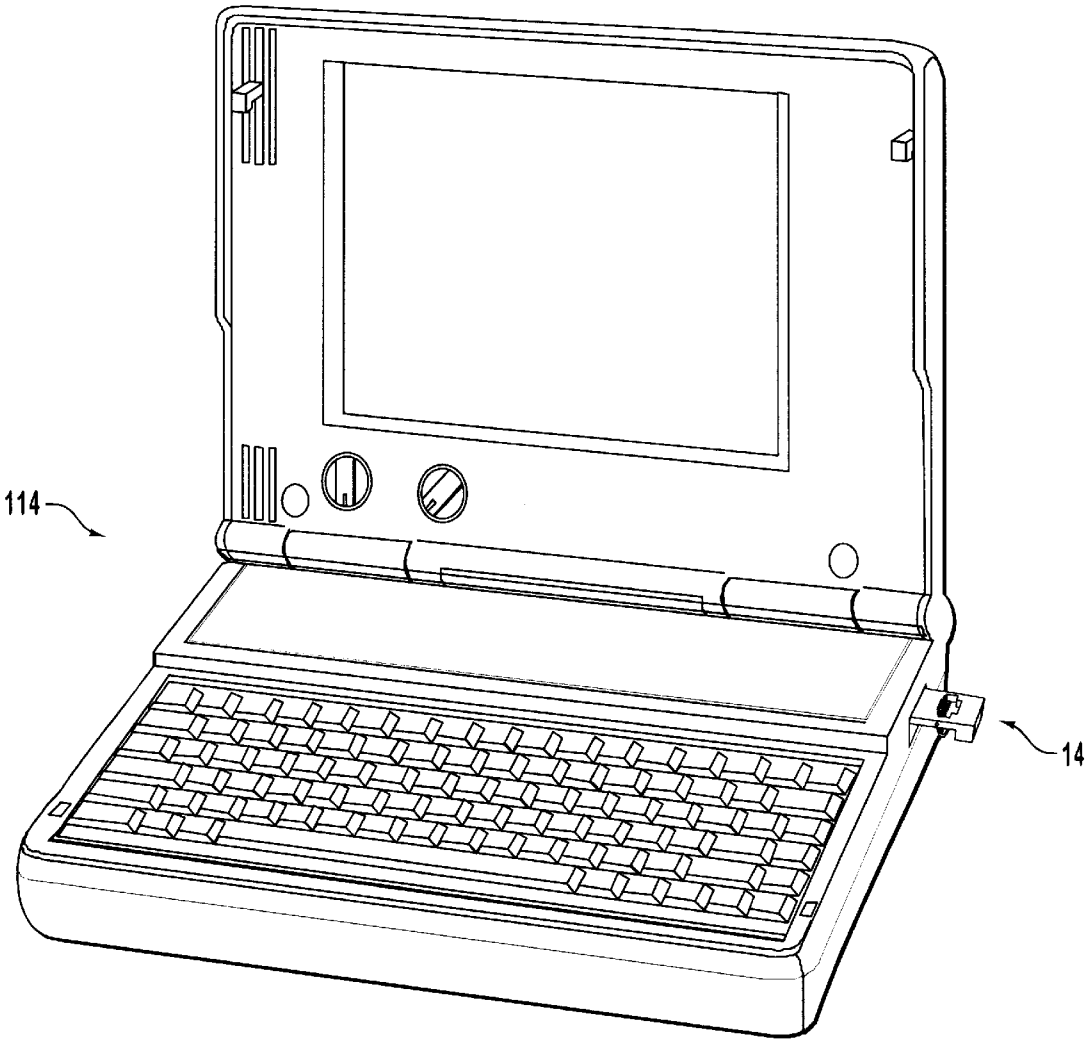
FIG. 7 is a perspective view of a computer having the inventive media jack shown in FIG. 1 directly mounted thereon.

Furthermore, the present invention also envisions that the inventive media jack need not be incorporated into a PC card. Rather, the inventive media jack can be incorporated directly onto an electrical apparatus such as a laptop computer, PIM, cellular telephone or other electrical apparatus containing a CPU. For example, depicted in FIG. 7, inventive media jack 14 is mounted directly on a laptop computer 114 without the use of a PC card. Examples of how media jacks can be directly mounted to electrical apparatus are disclosed in the '819 application which was previously incorporated herein by specific reference.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A media jack configured to electrically couple with a first media connector and a second media connector, the media jack comprising a movable plate having a top surface and a front face, the top surface bounding an aperture having a contact wire projecting therein, the aperture being configured to receive the first media connector such that the contact wire is in electrical communication with the first media connector, the front face of the housing bounding a front socket having an electrical contact positioned therein, the front socket being configured to receive the second media connector such that the electrical contact is in electrical communication with the second media connector.

2. A media jack as recited in claim 1, wherein the movable plate comprises an elongated body portion having an enlarged head portion formed on the end thereof and projecting below the body portion, the body portion having the aperture formed thereon and the head portion having the socket formed thereon.

3. A media jack as recited in claim 2, wherein the head portion has a back face positioned below the body portion, the back face having a contact received thereon, the contact being in electrical communication with the contact in the front socket.

4. A media jack as recited in claim 3, wherein the contact on the back face of the head portion is received within a slot.

5. A media jack as recited in claim 1, wherein the aperture is configured to receive an RJ type connector.

6. A media jack as recited in claim 1, wherein the socket is configured to receive a PC card type connector.

7. A PC card for electrically coupling with a first media connector and a second media connector, the PC card comprising:

(a) a housing including a top cover plate and a bottom cover plate bounding a compartment therebetween;

(b) a circuit board disposed within the compartment of the housing; and (c) a media jack including:

(i) a plate disposed within the compartment of the housing and having a top surface and a front face, the plate being movable between an extended position wherein a portion of the plate is disposed outside of the cover and a retracted position wherein the plate is substantially enclosed within the cover;

(ii) means at least partially disposed on the plate for electrically coupling the first media connector with the circuit board when the plate is in the extended position; and (iii) means at least partially disposed on the plate for electrically coupling the second media connector with the circuit board when the plate is in the retracted position.

8. A PC card as recited in claim 7, wherein the means for electrically coupling the first media connector comprises:

(a) an aperture formed on the top surface of the plate, the aperture being configured to receive the first media connector;

(b) a contact wire disposed on the plate and projecting into the aperture, the contact wire being configured to engage the first media connector in electrical connection when the first media plug is received within the aperture; and (c) a flexible wire ribbon extending from the wire contact to the circuit board.

9. A PC card as recited in claim 8, wherein the aperture is configured to receive a RJ type connector.

10. A PC card as recited in claim 7, wherein the means for electrically coupling the second media connector comprises:

(a) a socket formed on the front face of the plate, the socket being configured to receive the second media connector;

(b) an electrical contact positioned within socket, the electrical contact being configured to electrically couple with the second media connector when the second media connector is received within the socket;

(c) a electrical contact rigidly positioned within the compartment of the housing and electrically coupled with the circuit board; and (d) means for electrically coupling the electrical contact within the socket with the electrical contact within the compartment when the plate is in the retracted position.

11. A PC card as recited in claim 10, wherein the means for electrically coupling the electrical contact within the socket with the electrical contact within the compartment when the plate is in the retracted position comprises:

(a) the plate including an enlarged head with a back face facing the contact within the compartment; and (b) a contact mounted on the back face and being electrically coupled with the contact within the socket, the contact mounted on the back face being configured to bias in electrical communication with the contact within the compartment when the plate is moved into the retracted position.

12. A PC card as recited in claim 10, wherein the socket is configured to receive a PC card type connector.

13. A PC card as recite in claim 7, wherein at least a portion of the plate is positioned over the circuit board when the plate is in the retracted position.

14. An electrical apparatus for electrically coupling with a first media connector and a second media connector, the electrical apparatus comprising:

(a) a housing bounding a compartment;

(b) an electrical contact positioned within the compartment; and (c) a plate disposed within the compartment adjacent to the electrical contact, the plate being movable between an extended position wherein a portion of the plate is disposed outside of the housing and a retracted position wherein the plate is substantially enclosed within the housing, the plate comprising:

(i) a top surface having an aperture formed therein, the aperture being configured to receive the first media connector;

(ii) a front face having a socket formed therein, the socket being configured to receive the second media connector;

(iii) a second electrical contact positioned within socket and configured to electrically couple with the second media connector when the second media connector is received within the socket; and (iv) means for electrically coupling the first electrical contact and the second electrical contact when the plate is in the retracted position.

15. An electrical apparatus as recited in claim 14, wherein the means for electrically coupling the first electrical contact and the second electrical contact comprises:

(a) the plate including an enlarged head with a back face facing the first contact within the compartment; and (b) a contact mounted on the back face and being electrically coupled with the second contact within the socket, the contact mounted on the back face being configured to bias in electrical communication with the first contact within the compartment when the plate is moved into the retracted position.

16. An electrical apparatus as recited in claim 15, wherein the contact mounted on the back face is received within a slot formed on the back face.

17. An electrical apparatus as recited in claim 14, wherein the electrical apparatus is a PC card.

18. An electrical apparatus as recited in claim 14, wherein the electrical apparatus is a laptop computer.

* * * * *

UNITED STATES PATENT AND TRADEMARK OFFICE

CERTIFICATE OF CORRECTION

PATENT NO. : 6,033,240

DATED : March 7, 2000

INVENTOR(S) : Darrell E. Goff

It is certified that error appears in the above-identified patent and that said Letters Patent are hereby corrected as shown below:

Col. 2, line 57, after "after." delete --[dr]--

Col. 4, line 67, after "with" change "an" to --a--

Col. 5, line 29, after "electrically" change "communications" to --communicates--

Col. 8, line 28, after "within" add --the--

Signed and Sealed this

Seventeenth Day of April, 2001

*Attest:*

Nicholas P. Godici

NICHOLAS P. GODICI

*Attesting Officer*

*Acting Director of the United States Patent and Trademark Office*